US005082759A

United States Patent [19]

Kato et al.

[11] Patent Number: 5,082,759

[45] Date of Patent: Jan. 21, 1992

[54] LIQUID DEVELOPER FOR ELECTROSTATIC PHOTOGRAPHY

[75] Inventors: Eiichi Kato; Kazuo Ishii, both of Shizuoka, Japan

[73] Assignee: Fuji Photo Film Co., Ltd., Kanagawa, Japan

[21] Appl. No.: 421,570

[22] Filed: Oct. 11, 1989

[30] Foreign Application Priority Data

Oct. 12, 1988 [JP] Japan ..... 63-254785

[51] Int. Cl.[5] ..... G03G 9/13

[52] U.S. Cl. ..... 430/114; 430/115; 526/286; 526/292.1; 526/303.1; 526/319

[58] Field of Search ..... 430/114, 115

[56] References Cited

U.S. PATENT DOCUMENTS

| | | | |
|---|---|---|---|
| 4,579,803 | 4/1986 | Kato et al. | 430/114 |
| 4,618,557 | 10/1986 | Dan et al. | 430/114 |
| 4,665,002 | 5/1987 | Dan et al. | 430/114 |
| 4,837,102 | 6/1899 | Dan et al. | 430/114 |
| 4,840,865 | 6/1989 | Kato et al. | 430/114 |
| 4,983,486 | 1/1991 | Kato et al. | 430/115 |
| 5,006,441 | 4/1991 | Kato | 430/114 |

FOREIGN PATENT DOCUMENTS

| | | | |
|---|---|---|---|
| 185962 | 9/1985 | Japan | 430/114 |
| 6662 | 1/1986 | Japan | 430/114 |
| 151661 | 7/1986 | Japan | 430/114 |
| 209460 | 9/1986 | Japan | 430/114 |
| 231265 | 10/1987 | Japan | 430/114 |

*Primary Examiner*—Roland Martin

*Attorney, Agent, or Firm*—Sughrue, Mion, Zinn Macpeak & Seas

[57] ABSTRACT

A liquid developer for electrostatic photography comprising resin particles dispersed in a non-aqueous solvent whose electrical resistance is at least $10^9$ Ω·cm and whose the dielectric constant is not more than 3.5, wherein said dispersed resin particles are obtained by polymerizing a solution containing at least one monofunctional monomer (A) which is soluble in said non-aqueous solvent, but is rendered insoluble by polymerization and at least one monomer (B) represented by general formula (II) which has at least two polar groups and/or polar linking groups, in the presence of a resin for dispersion stabilization purposes which has a polymerizable double bond containing group which can copolymerize with the monofunctional monomer (A) at only one end of the main chain of a polymer containing at least one repeating unit which can be represented by the general formula (I):

(I)

(II)

12 Claims, No Drawings

LIQUID DEVELOPER FOR ELECTROSTATIC PHOTOGRAPHY

FIELD OF THE INVENTION

This invention relates to liquid developers for electrostatic photography wherein a resin is dispersed in a liquid carrier whose electrical resistance is $10^9$ Ω·cm or above and whose dielectric constant is not more than 3.5 and, more precisely, it relates to liquid developers which have excellent redispersion properties, storage properties, stability, image reproduction properties and fixing properties.

BACKGROUND OF THE INVENTION

In general, liquid developers for electrophotography are obtained by dispersing organic or inorganic pigments or dyes, such as carbon black, nigrosine or phthalocyanine blue, and a natural or synthetic resin, such as an alkyd resin, acrylic resin, rosin or synthetic rubber, in a liquid which has good insulating properties and a low dielectric constant, such as a petroleum based aliphatic hydrocarbon, and adding a polarity suppressing agent such as a metal soap, lecithine linseed oil, higher fatty acid or polymer which contains vinylpyrrolidone.

In developers of this type, the resin is dispersed in the form of insoluble latex particles with a particle diameter from a few nms to a few hundred nms, but in a conventional liquid developer there is inadequate bonding between a soluble resin which is used for dispersion stabilization purposes or the polarity controlling agent and the insoluble latex particles, as a result, soluble resin for dispersion stabilization purposes or the polarity controlling agent readily diffuses into the solution. Consequently, the soluble resin for dispersion stabilization purposes becomes separated from the insoluble latex particles on long term storage or repeated use and the particles may sediment, coagulate or lump together and the polarity becomes indistinct. Furthermore, it is difficult to redisperse particles once they have been sedimented or formed into lumps, as a result, the particles tend to stick to certain parts of the developing apparatus and they may contaminate the image parts or causes a breakdown of the developing machine by blocking pumps, for example.

It has been suggested that the insoluble latex particles should be chemically bound to the soluble resin for dispersion stabilization purposes an attempt to eliminate these disadvantages, and disclosures to this effect have been made, for example, in U.S. Pat. No. 3,990,980. However, although such liquid developers are somewhat better in terms of their dispersion stability with respect to the sedimentation of the particles themselves, the effect is not sufficient, and when these developers are used in actual developing apparatus, the toner becomes attached to various parts of the apparatus and solidifies in a film like coating and, moreover, there is a problem in that redispersion is difficult. This can lead to breakdown of the apparatus and contamination of the transferred images. Furthermore, the combinations of dispersion stabilizers and insolubilized monomers which can be used to prepare mono-disperse particles with a narrow particle size distribution is very limited in the methods of manufacture of resin particles disclosed in the above mentioned documents. Particles which have a wide particle size distribution containing large numbers of large, coarse particles or polydisperse particles in which two or more average particle sizes are present.

Furthermore, it is difficult to obtain the prescribed average particle size with particles in a mono-dispersion which has a narrow particle size distribution, and large particles of at least 1 μm, or very fine particles of less than 0.1 μm, are formed. Moreover, there is a further problem in that the dispersion stabilizers which are used must be prepared using a complicated and time consuming process.

Additionally, methods of overcoming the above mentioned problems in which the degree of dispersion of the particles, the .redispersion properties and the storage properties are improved by using insoluble dispersed resin particles of copolymers of insolubilized monomers and monomers which contain long chain alkyl groups or monomers which contain two or more polar components are disclosed, for example, in JP-A-60-179751 and JP-A-62-151868. (The term "JP-A" as used herein signifies an "unexamined published Japanese patent application".) Furthermore, methods in which the degree of dispersion of the particles, redispersion properties and storage stability are improved by means of insoluble dispersed resin particles comprised of copolymers of insolubilized monomers and monomers which contain long chain alkyl groups in the presence of polymers in which difunctional monomers have been .used or monomers in which macromolecular reactions are used have been disclosed, for example, in JP-A-166362 and JP-A-63-66567.

On the other hand, techniques in which more than copies are printed using offset printing master plates obtained using electrophotographic techniques have been introduced in recent years, and progress has been made in improving the master plates in particular and it is now possible to print in excess of 10,000 copies even with large plate sizes. Furthermore, progress has been made with shortening the operating time of the electrophotographic plate making system and improvements have been realized with the speeding up of the development/fixing processes.

The dispersed resin particles manufactured using the procedures disclosed in the aforementioned JP-A-60-179751, JP-A-62-151868, JP-A-62-166362 and JP-A-63-66567 do not always provide satisfactory performance in respect of particle dispersion properties and redispersion properties when development speeds are increased, and in respect of printing resistance when the fixing time is shortened or when the master plate is large (for example A3 size or greater).

The problems of conventional liquid developers of the type described above are solved by the present invention.

SUMMARY OF THE INVENTION

An object of the present invention is to provide liquid developers which have excellent dispersion stability, redispersion properties and fixing properties even in electrophotographic plate making systems which involve high speed development and fixing and in which large size master plates are being used.

Another object of the present invention is to provide liquid developers with which it is possible to form, by means of an electrophotographic process, offset printing original plates which have excellent printing ink sensitivity and printing resistance.

A further object of the present invention is to provide liquid developers which, in addition to the applications afore-mentioned, are appropriate for use in various electro-photographic applications and various copying applications.

An even further object of the present invention is to provide liquid developers for ink jet recording, cathode ray tube recording and recordings made, for example, when changes in pressure occur, or electrostatic variations occur.

The objects of the present invention are achieved by a liquid developers for electrostatic photography formed by dispersing a resin in a non-aqueous solvent of which the electrical resistance is at least $10^9$ Ω·cm and of which the dielectric constant is not more than 3.5, wherein the said dispersed resin particles are copolymer resin particles obtained by a polymerization of a solution which contains at least one monofunctional monomer (A) which is soluble in a non-aqueous solvent but which is rendered insoluble by polymerization and at least one type of monomer (B) represented by the general formula (II) indicated below which has at least two polar groups and/or polar linking groups, in the presence of a resin for dispersion stabilization purposes obtained by bonding a polymerizable double bond containing group which can be copolymerized with the mono-functional monomer (A) to only one end of the main chain of a polymer which has at least one repeating unit represented by the general formula (I) below.

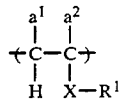

(I)

In general formula (I), X represents —COO—, —OCO—, —$CH_2OCO$—, —$CH_2COO$—, —O— or —$SO_2$—.

$R^1$ represents an aliphatic group which has from 6 to 32 carbon atoms.

Moreover, $a^1$ and $a^2$ which may be the same or different, each represents a hydrogen atom, a halogen atom, a cyano group, a hydrocarbyl group which has from 1 to 8 carbon atoms, a —COO—$R^2$ group or a —COO—$R^2$ group linked via a hydrocarbyl group which has from 1 to 8 carbon atoms and where $R^2$ represents a hydrocarbyl group which has from 1 to 22 carbon atoms.

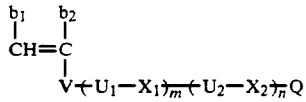

(II)

In general formula (II), V represents —O—, —COO—, —OCO—, —$CH_2OCO$—, —SO—, —CONH—, —$SO_2NH$—,

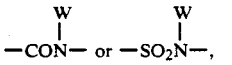

wherein W represents a hydrocarbyl group or the same meaning as the bonding group in the formula (II), —$U_1$—$X)_m$—$U_2$—$X_2)_nQ$.

Q represents a hydrogen atom or a hyirocarbyl group which has from 1 to 18 carbon atoms and which may be substituted with halogen, —OH, —CN, —$NH_2$, —COOH, —$SO_3H$ or —$PO_3H_2$.

$X_1$ and $X_2$ which may be the same or different, each represents —O—, —S—, —CO—, —$CO_2$—, —OCO—, —$SO_2$,

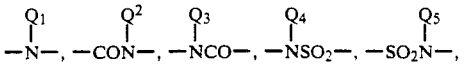

13 $NHCO_2$— or —NHCONH—, wherein $Q_1$, $Q_2$, $Q_3$, $Q_4$ and $Q_5$ have the same meaning as Q described above.

$U_1$ and $U_2$ which may be the same or different, each represents a hydrocarbyl group which has from 1 to 18 carbon atoms which may be substituted or which may insert a

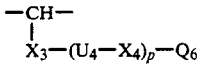

group into the bonds of the main chain, wherein $X_3$ and $X_4$ may be the same or different, having the same meaning as $X_1$ and $X_2$ described above, $U_4$ represents a hydrocarbonyl group which has from 1 to 18 carbon atoms which may be substituted, and $Q_6$ has the same meaning as Q described above.

Moreover, $b_1$ and $b_2$ which may be the same or different, each represents a hydrogen atom, a hydrocarbyl group, a —COO—L group or a —COO—L group linked via a hydrocarbyl group, where L represents a hydrogen atom or a hydrocarbyl group which may be substituted.

Moreover, m, n and p which may be the same or different, each represents an integer value of from 0 to 4.

Liquid developers of this invention are described in detail below.

DETAILED DESCRIPTION OF THE INVENTION

The use of linear chain or branched chain aliphatic hydrocarbons, alicyclic hydrocarbons or aromatic hydrocarbons, and halogen substituted derivatives thereof, is preferred for the carrier liquid whose electrical resistance is at least $10^9$ Ω·cm and whose dielectric constant is not more than 3.5 which is used in the present invention. For example, octane, isooctane, decane, iso-decane, decalin, nonane, dodecane, isododecane, cyclohexane, cyclo-octane, cyclodecane, benzene, toluene, xylene, mesitylene, Isopar-E, Isopar-G, Isopar-H, Isopar-L ("Isopar" is a trade name of the Exxon Co.), Shellsol 70, Shellsol 71 ("Shellsol" is a trade name of the Shell Oil Co.), Amsco OMS, Amsco 460 solvent ("Amsco" is a trade name of the Spirits Co.) can be used individually or in the form of mixtures for this purpose.

Resin particles which are dispersed in the non-aqueous solvent (referred to hereinafter as the latex particles) which are the most important constitutional component in the present invention are prepared as polymer particles in a non-aqueous solvent by the copolymerization of a mono-functional monomer (A) and a monomer (B) in the presence of a resin for dispersion stabilization purposes which has a polymerizable double bond group which can copolymerize with the mono-functional monomer (A) only at one end of the main chain of the polymer.

Here, the non-aqueous solvent is basically any solvent which is miscible with the carrier liquid of the aforementioned liquid developer for electrophotographic purposes.

That is to say, the solvents which can be used when preparing the dispersed resin particles should be miscible with the aforementioned carrier liquids, and the use of linear chain or branched chain aliphatic hydrocarbons, alicyclic hydrocarbons, aromatic hydrocarbons and halogen substituted derivatives thereof is preferred. For example, hexane, octane, iso-octane, decane, isodecane, decalin, nonane, dodecane, iso-dodecane, Isopar-E, Isopar-G, Isopar-H, Isopar-L, Shellsol 70, Shellsol 71, Amsco OMS and Amsco 460 solvent can be used individually or in the form of mixtures for this purpose.

Solvents which can be used as mixtures with these organic solvents include alcohols (for example, methyl alcohol, ethyl alcohol, propyl alcohol, butyl alcohol, fluorinated alcohol), ketones (for example, acetone, methyl ethyl ketone, cyclohexanone), carboxylic acid esters (for example, methyl acetate, ethyl acetate, propyl acetate, butyl acetate, methyl propionate, ethyl propionate), ethers (for example, diethyl ether, dipropyl ether, tetrahydrofuran, dioxane), and halogenated hydrocarbons (for example, methylene dichloride, chloroform, carbon tetrachloride, dichloroethane, methylchloroform).

The non-aqueous solvents used in these mixtures are preferably distilled off by heating or by reducing the pressure after the particles have been made by polymerization, but they may be included in the latex particle dispersion for the liquid developer without causing problems provided that a resistance of at least $10^9$ Ω·cm is still maintained by the developer liquid.

The use of the same solvent as that used for the carrier liquid is normally preferred during the preparation of the resin dispersion and, as mentioned earlier, it is possible to use linear or branched chain aliphatic hydrocarbons, alicyclic hydrocarbons, aromatic hydrocarbons and halogenated hydrocarbons, for example, for this purpose.

The resin for dispersion stabilization purposes in this invention which is used when forming the solvent insoluble copolymer by copolymerizing the mono-functional monomer (A) and the monomer (B) in the non-aqueous solvent is a polymer in which a polymerizable double bond group which can copolymerize with the mono-functional monomer (A) is bound only to the end of the main chain of the polymer, the polymer including at least one type of repeating unit which can be represented by the general formula (I).

The aliphatic groups and hydrocarbyl groups in the repeating unit represented by general formula (I) may be substituted.

In general formula (I), X preferably represents —COO—, —OCO—, —$CH_2$OCO—, —$CH_2$COO— or —O— and, more preferably, X represents —COO—, —$CH_2$COO— or —O—.

$R^1$ preferably represents an alkyl group having from 8 to 22 carbon atoms, an aralkyl group having from 8 to 22 carbon atoms, an alkenyl group having from 8 to 22 carbon atoms or substituted group thereof. Examples of suitable substituent groups include halogen atoms (for example, fluorine, chlorine, bromine), —O—$R^3$, —COO—$R^3$, and —OCO—$R^3$, wherein $R^3$ represents an alkyl group which has from 6 to 22 carbon atoms, for example, hexyl, octyl, decyl, dodecyl, hexadecyl, octadecyl). More preferably, $R^1$ represents an alkenyl group having from 8 to 22 carbon atoms or an alkyl group having from 8 to 22 carbon atoms, for example, octyl, decyl, dodecyl, tridecyl, tetradecyl, hexadecyl, octadecyl, docosanyl, octenyl, decenyl, dodecenyl, tetradecenyl or octadecenyl.

Moreover, $a_1$ and $a_2$ may be the same or different, and they preferably represent hydrogen atoms, halogen atoms (for example, fluorine, chlorine, bromine), cyano groups, alkyl groups which have from 1 to 3 carbon atoms, —COO—$R^2$ groups or $CH_2$COO—$R^2$ groups (where $R^2$ preferably represents an aliphatic group which has from 1 to 22 carbon atoms). More preferably, $a_1$ and $a_2$ which may be the same or different, each representing a hydrogen atom, an alkyl group which has from 1 to 3 carbon atoms (for example, methyl, ethyl, propyl), a —COO—$R^2$ group or a —$CH_2$COO—$R^2$ group (where $R^2$, more preferably, represents an alkenyl group having from 2 to 28 carbon atoms or an alkyl group having from 1 to 18 carbon atoms, for example methyl, ethyl, propyl, butyl, hexyl, octyl, decyl, dodecyl, tridecyl, tetradecyl, hexadecyl, octadecyl, pentenyl, hexenyl, octenyl, or decenyl, and these alkyl and alkenyl groups may have substituent groups similar to those for $R^1$).

The polymerizable double bond grups which are bound to the end of the polymer main chain are groups which can copolymerize with the mono-functional monomer (A), and actual examples of such groups are indicated below.

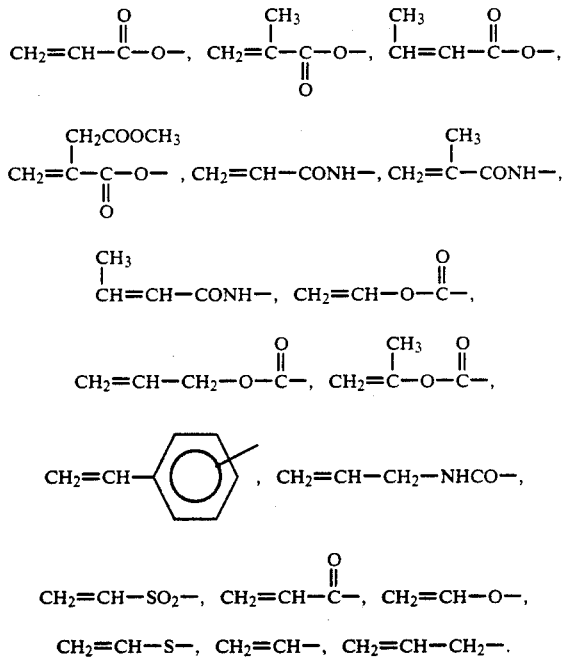

These polymerizable double bond groups have a chemical structure which is bonded directly to one end of the polymer main chain or which is bonded thereto by an optional linking group.

These linking groups may have a structure comprising any combination of atoms including carbon carbon bonds (single or double bonds), carbon—hetero atom bonds (where the hetero atom is oxygen, sulfur, nitrogen or silicon, for example), and hetero atom—hetero atom bonds. For example, the linking group may be a single linking group selected from among the groups

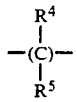

group (where $R^4$ and $R^5$ represent hydrogen atoms, halogen atoms (for example, fluorine, chlorine, bromine), cyano groups, hydroxyl groups, alkyl groups (for example, methyl, ethyl, propyl), —CH=CH),

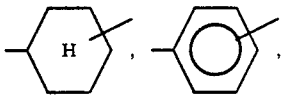

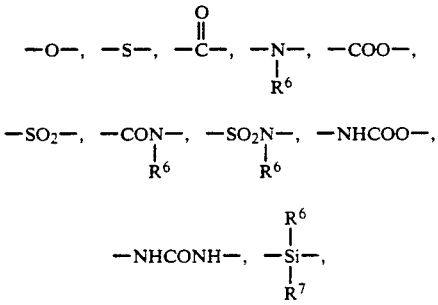

wherein $R^6$ and $R^7$ each represents hydrogen atoms or hydrocarbyl groups which have the same meaning as $R^2$ in the aforementioned general formula (I), or any combination of these groups.

The polymer component of the resin for dispersion stabilization purposes of this invention is a homopolymer or copolymer component selected from among the repeating units represented by the general formula (I), or a copolymer component obtained by polymerizing a monomer corresponding to a repeating unit represented by general formula (I) and another polymerizable monomer. Other monomers which can form copolymer components with the polymer components represented by general formula (I) include the compounds which can be represented by the general formula (III).

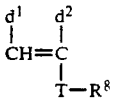

(III)

T in general formula (III) represents —COO—, —OCO—, —$CH_2$OCO—, —$CH_2$COO—, —O—,

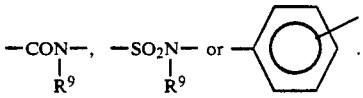

Rhu 9 represents a hydrogen atom or an aliphatic group which has from 1 to 18 carbon atoms and which may be substituted (for example, methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, di-methylbenzyl, fluorobenzyl, 2-methoxyethyl, 3-methoxypropyl).

$R^8$ represents a hydrogen atom or an aliphatic group which has from 1 to 6 carbon atoms and which may be substituted (for example, methyl, ethyl, propyl, butyl, 2-chloroethyl, 2,2-dichloroethyl, 2,2,2-trichloroethyl, 2-bromoethyl, 2-glycidylethyl, 2-hydroxyethyl, 2-hydroxypropyl, 2,3-dihydroxyethyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-morpholinoethyl, 2-carboxyethyl, 3-carboxypropyl, 4-carboxybutyl, 2-phosphoethyl, 3-sulfopropyl, 4-sulfobutyl, 2-carboxamidoethyl, 3-sulfoamidopropyl, 2-N-methylcarboxyamidoethyl, cyclopentyl, chlorocyclohexyl, di-chlorohexyl).

Moreover, $d^1$ and $d^2$ may be the same or different, each having the same meaning as $a^1$ or $a^2$ in the aforementioned general formula (I).

Actual examples of monomers represented by general formula (III) include vinyl esters or allyl esters of aliphatic carboxylic acids which have from 1 to 6 carbon atoms (for example, acetic acid, propionic acid, butyric acid, monochloroacetic acid, trifluoropropionic acid), alkyl esters or amides of unsaturated carboxylic acids, such as acrylic acid, methacrylic acid, crotonic acid, itaconic acid and maleic acid, wherein the alkyl groups have from 1 to 4 carbon atoms and may be substituted (examples of such alkyl groups include methyl, ethyl, propyl, butyl, 2-chloroethyl, 2-bromoethyl, 2-chloroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-fufurylethyl, 2-pyridinylethyl, 2-thienylethyl, trimethoxysilylpropyl, 2-carboxyamidoethyl), styrene derivatives (for example, styrene, vinyltoluene, α-methylstyrene, vinylnaphthalene, chlorostyrene, di-chlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxyamide, vinylbenzenesulfoamide), unsaturated carboxylic acids such as acrylic acid, methacrylic acid, crotonic acid, maleic acid and itaconic acid, for example, or the cyclic anhydrides of maleic acid and itaconic acid, acrylonitrile, methacrylonitrile, and heterocyclic compounds which contain a polymerizable double bond (such as the compounds disclosed in the Polymer Society publication entitled "The Polymer Data Handbook, Fundamentals Edition", pages 175–184 (Published by Baifukan, 1986), for example, N-vinylpyridine, N-vinylimidazole, N-vinylpyrrolidone, vinylthiophene, vinyltetrahydrofuran, vinyloxazoline, vinylthiazole, and N-vinylmorpholine).

Two or more of the monomers represented by general formula (III) can be used conjointly.

The aforementioned repeating unit represented by general formula (I) accounts for from 30 wt% to 100 wt%, and preferably for from 50 wt% to 100 wt%, of the resin polymer for dispersion stabilization purposes used in this invention.

The resin for dispersion stabilization purposes of this invention which has a polymerizable double bond bound only at one end of the main polymer chain can be prepared easily by a method in which a polymerizable double bond group is introduced by reacting various reagents which have a polymerizable double bond with living polymers which have been obtained by conventional methods of anionic or cationic polymerization, or a method reacting a reagent which contains a "specified reactive group" (for example —OH, —COOH, —$SO_3H$, —$NH_2$, —SH, —$PO_3H_2$, —NCO, —NCS,

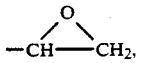

—COCl, —$SO_2Cl$) and then introducing polymerizable double bond into the products thus obtained by polymerization reaction with the end of such a living polymer and then introducing polymerizable double bond int the products thus obtained by polymerization reaction (methods involving ionic polymerization) or a method in which radical polymerization is carried out using polymerization initiators and/or chain transfer agents which contain the aforementioned "specified reactive groups" within the molecule, and in which a polymerizable double bond is then introduced by way of a polymer reaction using the "specified reactive groups" which are bound only at the end of the main polymer chains.

In practice, these resins can be prepared using the methods disclosed in reviews, such as those by P. Dreyfuss & R. P. Quirk, Encycl. Polym. Sci. Eng., 7, 551 (1987), Nakajo & Yamashita, Dyes and Reagents, 30, 232 (1985), Ueda and Nagai, Science & Industry, 60, 57 (1986), P. F. Rempp & E. Franta, Advances in Polymer Science, 58, 1 (1984), Ito, Polymer Processing, 35, 262 (1986) V. Percec, Applied Polymer Science, 285, 97 (1984), for example, and in the literature cited therein.

The weight average molecular weight of the resin for dispersion stabilization purposes used in this invention is preferably from $1\times10^4$ to $5\times10^5$, and, more preferably, from $2\times10^4$ to $2\times10^5$.

Actual examples of resins for dispersion stabilization purposes which can be used in the invention are indicated below, but the invention is not limited by these examples.

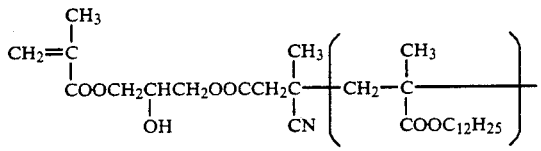

(I-1)

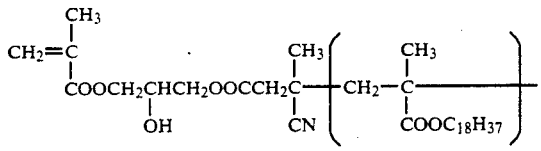

(I-2)

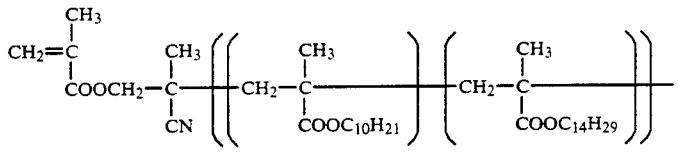

(I-3)

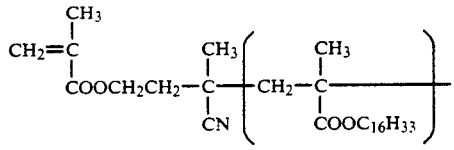

(I-4)

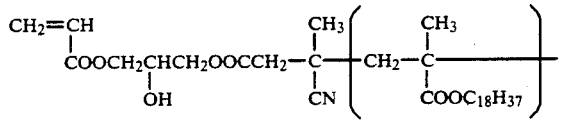

(I-5)

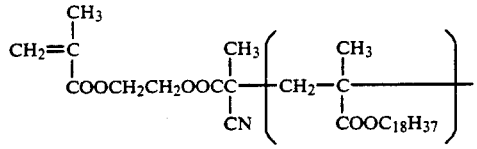

(I-6)

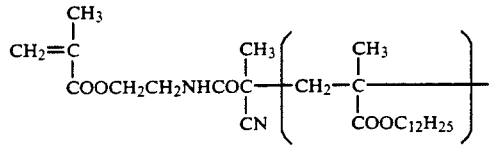

(I-7)

-continued
(I-8)
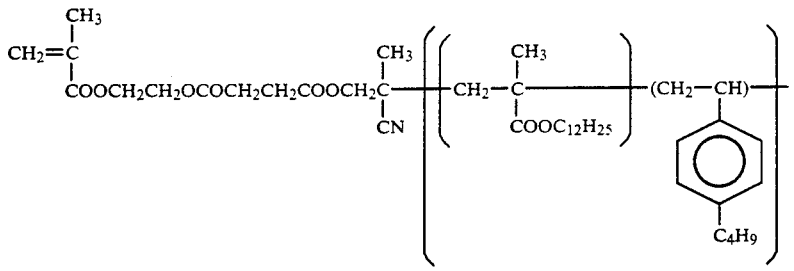
(I-9)
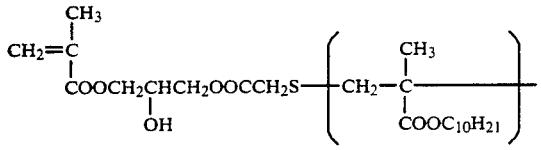
(I-10)
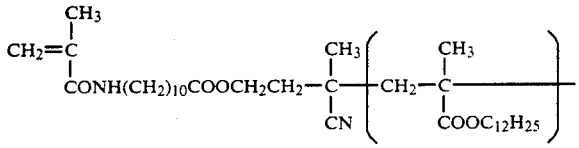
(I-11)
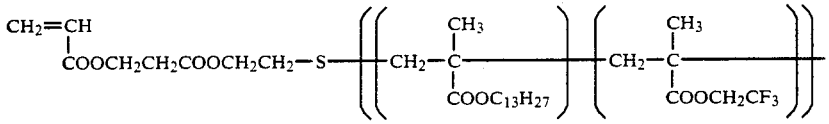
(I-12)
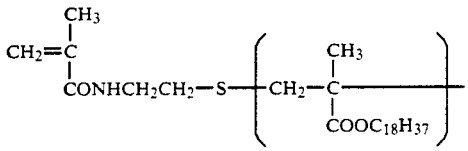
(I-13)
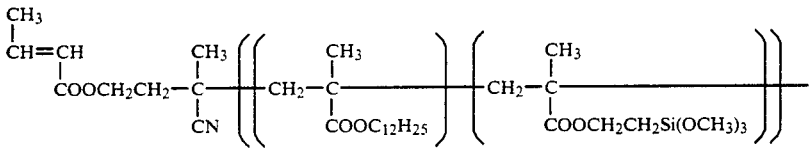
(I-14)
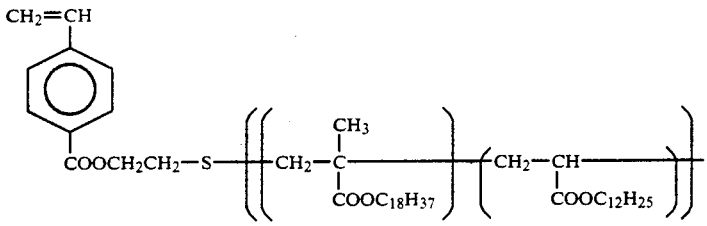
(I-15)
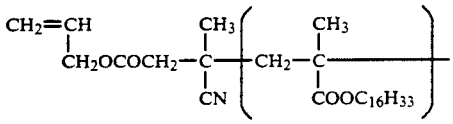
(I-16)
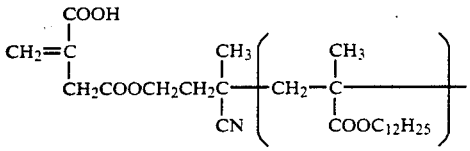

-continued
(I-17)
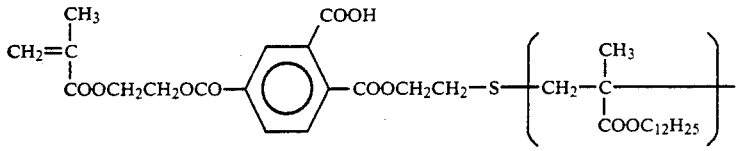
(I-18)
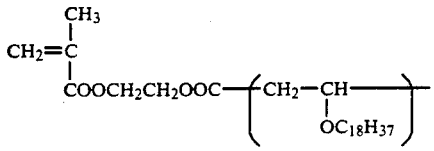
(I-19)
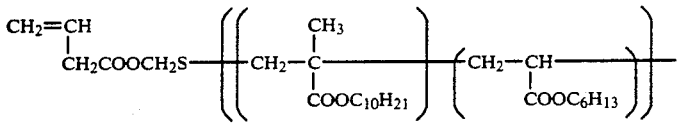
(I-20)
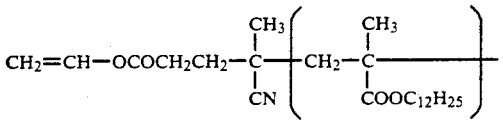
(I-21)
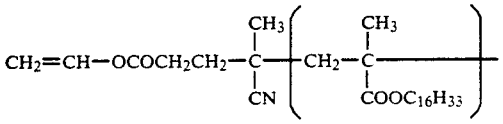
(I-22)
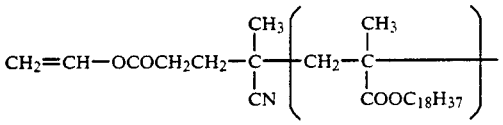
(I-23)
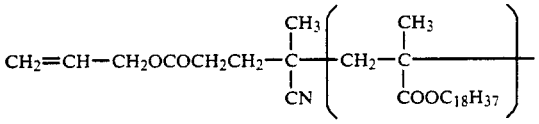
(I-24)
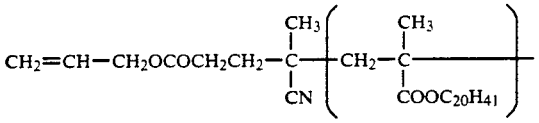
(I-25)
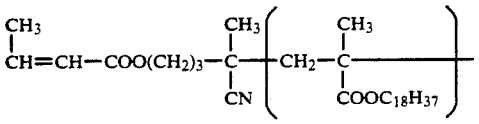
(I-26)
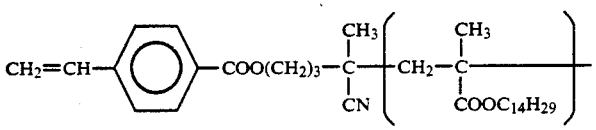
(I-27)
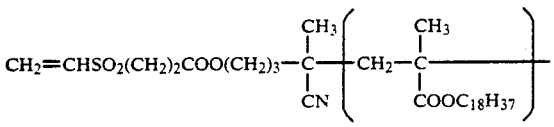

The monomers used when preparing the non-aqueous dispersed resins can be classified as monofunctional monomers (A) which are soluble in the non-aqueous solvent but which are rendered insoluble by polymerization, and monomers (B) which contain at least two polar groups and/or polar linking groups represented by the aforementioned general formula (II) and which form copolymers with the monomer (A).

The monomer (A) in this invention is any monofunctional monomer which is soluble in non-aqueous solvents but rendered insoluble by polymerization. Actual examples of such monomers include those which can be represented by the general formula (IV).

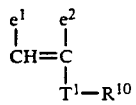

(IV)

In general formula (IV), $T^1$ represents —COO—, —OCO—, —$CH_2$OCO—, —$CH_2$COO—, —O—,

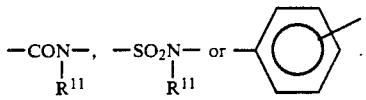

Here, $R^{11}$ represents a hydrogen atom or an aliphatic group which has from 1 to 18 carbon atoms and which may be substituted (for example, methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl,fluorobenzyl, 2-methoxyethy1,3-methoxypropyl).

$R^{10}$ represents a hydrogen atom or an aliphatic group which has from 1 to 6 carbon atoms which may be substituted (for example, methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxyethyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropy1,4-sulfobutyl, 2-carboxyamidoethy1,3-sulfoamidopropyl, 2-N-methylcarboxyamidoethyl, cyclopentyl, chlorocyclohexyldichlorohexyl).

Moreover, $e^1$ and $e^2$ which may be the same or different, each has the same measing as $a^1$ or $a^2$ in the aforementioned general formula (I).

Actual examples of the monofunctional monomer (A) include the vinyl esters or acrylic esters of aliphatic carboxylic acids which have from 1 to 6 carbon atoms (for example, acetic acid, propionic acid, butyric acid, monochloroacetic acid, trifluoropropionic acid), alkyl esters or amides being optionally substituted and having from 1 to 4 carbon atoms, of unsaturated carboxylic acids, such as acrylic acid, methacrylic acid, crotonic acid, itaconic acid and maleic acid (wherein examples of the alkyl groups include methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-sulfobutyl, 3-chloropropyl, 2-hydroxy-3-chloropropyl, 2-furfurylethyl, 2-pyridinylethyl, 2-thienylethyl, trimethoxysilylpropyl and 2-carboxyamidoethyl), styrene derivatives (for example, styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxamide, vinylbenzenesulfoamide), unsaturated acids such as acrylic acid, methacrylic acid, crotonic acid, maleic acid or itaconic acid, for example, or cyclic anhydrides of maleic acid or itaconic acid, acrylonitrile, methacrylonitrile, and heterocyclic compounds which contain a polymerizable double bond (actual examples include the compounds disclosed on pages 175–184 of the Macromolecular Society publication entitled "Polymer Data Handbook, Fundamentals Edition", published by Baifukan (1986), for example, N-vinylpyridine, N-vinylimidazole, N-vinylpyrrolidone, vinylthiophene, vinyltetrahydrofuran, vinyloxazoline, vinylthiazole and N-vinylmorpholine).

Two or more of the monofunctional monomers (A) can be used conjointly.

The monomer (B) represented by general formula (II) which is used in the invention is described in more detail below.

In general formula (II), V preferably represents —O—, —COO—, —OCO—, —$CH_2$OCO—, —CONH— or

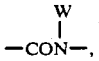

wherein W is preferably an alkyl group which has from 1 to 16 carbon atoms and which may be substituted, an alkenyl group which has from 2 to 16 carbon atoms and which may be substituted, an alicyclic group which has from 5 to 18 carbon atoms and which may be substituted, or a group which has the same significance as the bond group, $-Q_1-X_1)_m-U_2-X_2)_n Q$, in general formula (II).

Q preferably represents a hydrogen atom or an aliphatic group which has a total number of from 1 to 16 carbon atoms which may be substituted with halogen atoms (for example, chlorine, bromine), —OH, —CN or —COOH (examples of aliphatic groups include alkyl groups, alkenyl groups and aralkyl groups).

$X_1$ and $X_2$ may be the same or different, and they preferably represent —O—, —S—, —CO—, —COO—, —OCO—,

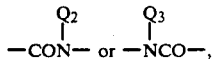

wherein $Q_2$ and $Q_3$ each has the same meaning as Q described above).

$U_1$ and $U_2$ which may be the same or different preferably represent hydrocarbyl groups which have from 1 to 12 carbon atoms which may be substituted or which may insert $$-\underset{\substack{|\\ X_3-(U_4-X_4)_p-Q_6}}{CH}-$$

into the bonds of the main chain. Examples of such hydrocarbyl groups include alkylene groups, alkynylene groups, arylene groups and cycloalkylene groups). Here, $X_3$ and $X_4$ may be the same or different, having the same meaning as $X_1$ and $X_2$ described above, $U_4$ preferably represents an alkylene group, alkenylene group or arylene group which has from one to 12 carbon atoms, which may be substituted, and $Q_6$ has the same meaning as Q described earlier.

Moreover, $b_1$ and $b_2$ which may be the same or different, each preferably represents hydrogen atom, methyl group —COO—L group or —$CH_2$COO—L group (where L preferably represents a hydrogen atom, an alkyl group, alkenyl group, aralkyl group or cycloalkyl group which has from 1 to 18 carbon atoms).

Moreover, m, n and p which may be the same or different, each preferably represents the number 0, 1, 2 or 3.

Moreover, more preferably, V in general formula (II) represents —COO—, —CONH— or $$-\overset{\overset{W}{|}}{CON}-,$$

and $b_1$ and $b_2$ which may be the same or different, each represents a hydrogen atom, methyl group, —COO—L group or —$CH_2$COO-L group (where L preferably represents an alkyl group which has from 1 to 12 carbon atoms).

Moreover, actual examples of $U_1$ or $U_2$ are may be constructed by combining groups such as $$-\underset{\substack{|\\ R_{13}}}{\overset{\overset{R^{12}}{|}}{(C)}}-,$$

wherein $R^{12}$ and $R^{13}$ represent hydrogen atom, alkyl groups or halogen atoms, for example),

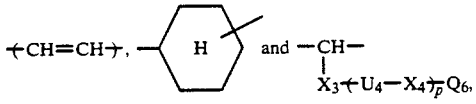

wherein $X_3$, $X_4$, $Q_6$, $U_4$ and p have the same meaning as before.

The linking main chain which forms the bond group —V—$U_1$—$X_1)_m$—$U_2$—$X_2)_nQ$, in general formula (II) preferably constructed by from V to Q (which is to say V, $U_1$, $X_1$, $U_2$, $X_2$ and Q) is preferably at least 8 of a total atoms. Here, when V represents $$-\overset{\overset{W}{|}}{CON}- \text{ or } -\overset{\overset{W}{|}}{SO_2N}-$$

and W represents —$(U_1$—$X_1)_m$—$U_2$—$X_2)_nQ$, the linking main chain constructed from W is also included in the aforementioned linking main chain. Moreover, when $U_1$ and $U_2$ each is a hydrocarbyl group which may insert $$-\underset{\substack{|\\ X_3-(U_4-X_4)_p-Q_6}}{CH}-$$

bonds into the main chain, $X_3$—$U_4$—$X_4)_p$—$Q_6$ is also included in the aforementioned linking main chain. The number of atoms in the linking main chain does not include the atoms in the oxo group (=O group) or hydrogen atoms when V represents —COO—or —CONH—, for example, but it does include the carbon atoms, ether type oxygen atoms and nitrogen atoms from which the linking main chain is constructed. Hence, the —COO—and —CONH— groups both count as 2 atoms in the linking main chain. Similarly, when Q represents a —$C_9H_{19}$ group, the carbon atoms are included in the number of atoms but the hydrogen atoms are not included, and in this case the number of atoms is 9.

The compounds indicated below can be cited as actual examples of the monomer (B).

$$CH_2=\overset{\overset{CH_3}{|}}{C}-COO(CH_2)_2OCOC_9H_{19} \quad \text{(II-1)}$$

$$CH_2=\overset{\overset{CH_3}{|}}{C}-COO(CH_2)_2OCOC_{11}H_{23} \quad \text{(II-2)}$$

$$CH_2=\overset{\overset{CH_3}{|}}{C}-COO(CH_2)_2OCO(CH_2)_5OCOCH_3 \quad \text{(II-3)}$$

$$CH_2=\overset{\overset{CH_3}{|}}{C}-COO(CH_2)_{10}OCOC_6H_{13} \quad \text{(II-4)}$$

$$CH_2=\overset{\overset{CH_3}{|}}{C}-COO(CH_2)_{10}COOC_8H_{17} \quad \text{(II-5)}$$

$$CH_2=\overset{\overset{CH_2COOCH_3}{|}}{C}-COO(CH_2)_3COOC_4H_9 \quad \text{(II-6)}$$

$$CH_2=\overset{\overset{CH_3}{|}}{C}-CONH(CH_2)_6COOC_8H_{17} \quad \text{(II-7)}$$

$$CH_2=\overset{\overset{CH_3}{|}}{C}-COO(CH_2)_2NHCO(CH_2)_3COOCH_3 \quad \text{(II-8)}$$

$$CH_2=\overset{\overset{H}{|}}{C}-COO(CH_2)_3OCOCH=CH-COOC_6H_{13} \quad \text{(II-9)}$$

-continued (II-10)

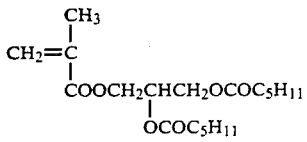

(II-11)

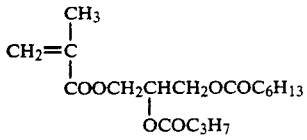

(II-12)

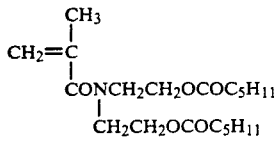

(II-13)

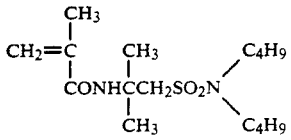

(II-14)

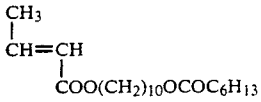

(II-15)

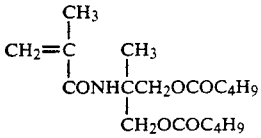

(II-16)

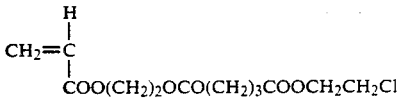

(II-17)

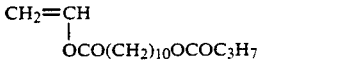

(II-18)

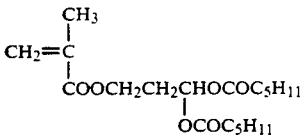

(II-19)

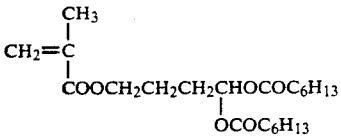

(II-20)

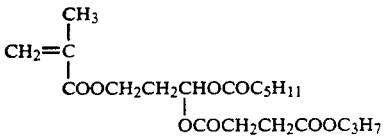

(II-21)

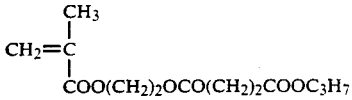

-continued (II-22)

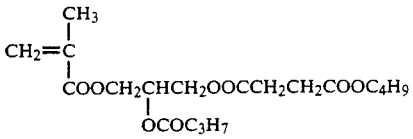

(II-23)

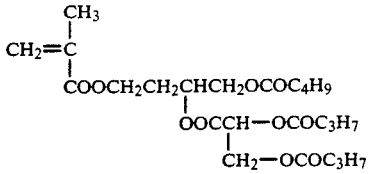

(II-24)

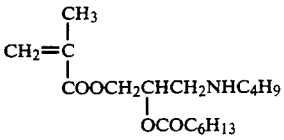

(II-25)

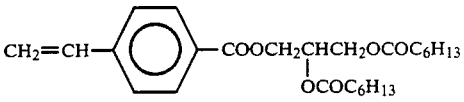

(II-26)

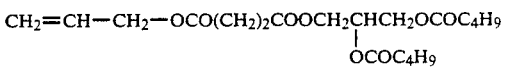

(II-27)

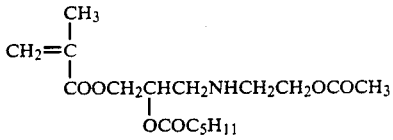

(II-28)

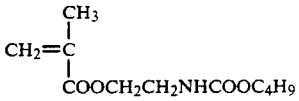

(II-29)

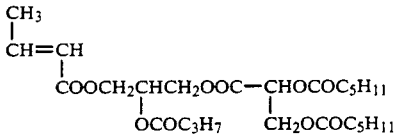

The dispersed resins of this invention are comprised of at least one monomer (A) and at least one monomer (B), and the important fact is that a desired dispersed resin can be obtained provided that the resin synthesized from these monomers is insoluble in non-aqueous solvent. In more practical terms, the use of an amount of from 0.1 to 30 wt % with respect to the insolubilized monomer (A) of the monomer (B) represented by the general formula (II) is preferred, and the use of an amount of from 0.2 to 10 wt % is more preferable. Furthermore, the molecular weight of the dispersed resin of this invention is preferably from $10^3$ to $10^6$, and more preferably from $10^4$ to $10^6$.

In general, the dispersed resins of the type described above which are used in the invention can be prepared by polymerization of a resin for dispersion stabilization purposes as described earlier, a monomer (A) and a monomer (B) in a non-aqueous solvent under heating in the presence of a polymerization initiator such as benzoyl peroxide, azobis(isobutyronitrile) or butyl lithium.

In practice, there are methods in which a polymerization initiator is added to solution containing a mixture of resin for dispersion stabilization purposes, monomer (A) and monomer (B), methods in which monomer (A) and monomer (B) are drip fed along with the polymerization initiator into a solution wherein the resin for dispersion stabilization purposes is dissolved, methods in which part of the monomer (A) and the monomer (B) are dissolved with all of the resin for dispersion stabilization purposes to form a solution to which the remainder of the monomer mixture is added arbitrarily, together with the polymerization initiator, and methods in which a mixture of the resin for dispersion stabilization purposes and monomers are added optionally together with the polymerization initiator to a non-aqueous solvent, and the dispersed resin can be prepared using any of these methods.

The total amount of monomer (A) and monomer (B) is within the range of some 3 to 80 parts by weight, and preferably from 5 to 50 parts by weight, per 100 parts by weight of non-aqueous solvent.

The soluble resin which is the dispersion stabilizing agent is used at a rate of from 1 to 100 parts by weight, and preferably at a rate of from 5 to 50 part by weight, per 100 parts of all the monomers mentioned above.

The amount of polymerization initiator is suitably from 0.1% to 5% (by weight) of the total amount of monomer.

The polymerization temperature is from 50° C. to 180° C., and preferably from 60° C. to 120° C. The reaction time is preferably from 1 to 15 hours.

In cases where polar solvents, such as the aforementioned alcohols, ketones, ethers, esters etc. are used conjointly in the non-aqueous solvents used in the reaction and in cases where unreacted monomer (A) or monomer (B) which is being polymerized to form particles remains in the solvent, the said solvent or monomer is preferably distilled off by raising the temperature above the boiling point of the said solvent or monomer, or by-distilling off the solvent or monomer under reduced pressure.

The non-aqueous based latex particles prepared in the way described above are fine particles which have a uniform particle size distribution, and at the same time they exhibit very stable dispersion properties, the dispersion properties being especially good with long term repetitive use in developing apparatus. Moreover, they are easily redispersed, even with increased developing speeds, and no attachment to various parts of the apparatus and contamination is observed at all.

Furthermore, when fixed by heating, for example, they form a strong, solid film and they exhibit excellent fixing properties.

Moreover, the liquid developers of this invention have excellent dispersion stability, redispersion properties and fixing properties even when used in rapid development/fixing processes and for large size master plates.

Coloring agents may be used in the liquid developers of this invention, as required.

No particular limitation is imposed upon the coloring agent, and the various pigments and dyes known conventionally can be used for this purpose.

In cases where the dispersed resin is itself to be colored, the chloration can be achieved, for example, by physical dispersion within the dispersed resin using pigments or dyes, and there are many known pigments and dyes which can be used for this purpose. Examples include magnetic iron oxide powder, powdered lead iodide, carbon black, nigrosine, Alkali Blue, Hanza Yellow, Quinacridone Red and Phthalocynaine Blue.

The methods in which the dispersed resins are dyed with the preferred dyes, as disclosed, for example, in JP-A-57-48738, is another method of coloration. Alternatively, dyes can be chemically bonded with the dispersed resin, as disclosed in JP-A-53-54029, or a monomer which contains a coloring agent can be used when preparing the polymerized particles to provide a coloring agent containing copolymer, as disclosed, for example, in JP-B-44-22955. (The term "JP-B" as used herein signifies an "examined Japanese patent publication".)

Various additives can be included, as required, in the liquid developers of this invention with a view to reinforcing charging characteristics or with a view to improving image characteristics, and examples of such additive have been disclosed by Harazaki in "Electrophotography", Vol.16, No.2, page 44.

For example, use can be made of metal salts of di-2-ethylhexylsulfosuccinic acid, metal naphthenates, metal salts of higher fatty acids, lecithin, poly(vinylpyrrolidone) and copolymers which contain a hemi-maleic acid amide components.

The amounts of each of the principal components in a liquid developer of this invention are indicated below.

The toner particles wherein a resin (which may involve the use of a coloring agent, as desired) is the main component is preferably included at a rate of from 0.5 to 50 parts by weight per 1,000 parts by weight of carrier liquid. If the amount used is less than 0.5 parts by weight the image density obtained is insufficient, and if more than 50 parts by weight are used then fogging is liable to occur in non-image parts. Moreover, the carrier liquid soluble resin for dispersion stabilization purposes mentioned earlier can also be used, as required, and it can be added at a rate ranging from 0.5 to 100 parts by weight per 1,000 parts by weight of carrier liquid. The charging control agents mentioned above are preferably used at a rate of from 0.001 to 1.0 part by weight per 1000 parts by weight of carrier liquid. Moreover, various additives may be added, as required, and the total amount of these additives is limited by the upper level of the electrical resistance of the developer. That is to say, it is difficult to obtain continuous tone images of good quality if the electrical resistance of the liquid developer in the state where the toner particles have been removed is lower than $10^9$ Ω·cm and, therefore, the amount of the various additives added must be controlled within these limits.

ILLUSTRATIVE EXAMPLES

Illustrative examples of the invention are described below, but the invention is not limited by these examples.

EXAMPLE 1

The Preparation of a Reisn for Dispersion Stabilization Purposes: Preparation of the Resin P-1

A mixed solution comprising 100 grams of octadecyl methacrylate, 150 grams of toluene and 50 grams of isopropanol was heated to a temperature of 75° C. under a blanket of nitrogen. Two grams of 4,4'-azobis(4-cyanovaleric acid) (referred to hereinafter as A.C.V.) was added, and then 0.5 g of A.C.V. was added, with agitation, and the mixture was reacted for a period of 4 hours. After cooling, the mixture was reprecipitated in 3 liters of methanol and the material was recovered by filtration and dried, whereupon 83 grams of a white powder was obtained.

A mixture comprising 50 grams of the above mentioned powder and 100 grams of toluene was heated to 40° C. and agitated to form a solution. Next, 0.2 gram of t-butylhydroquinone, 3.0 grams of vinyl acetate and 0.025 gram of silver acetate were added and the mixture was reacted for a period of 2 hours. The temperature was then raised to 70° C., b $3.4\times10^{-3}$ ml of 100% sulfuric acid was added and the mixture was reacted for a period of 18 hours. After reaction, 0.02 gram of sodium acetate trihydrate was added to the reaction mixture and, after agitating for 30 minutes, the mixture was cooled and reprecipitated in 1.5 liters of methanol, whereupon 38 grams of a slightly brown colored powder was obtained. The weight average molecular weight of this powder was 88,000.

EXAMPLES 2–10

The Preparation of a Resin for Dispersion Stabilization Purposes: Preparation of the Resins P-2–P-10

Each of the resins P-2 to P-10 was prepared using the same procedure as in Example 1 of the preparation of a resin for dispersion stabilization purposes except that the monomers shown in Table 1 were used in place of the octadecyl methacrylate. Polymers having a weight average molecular weight from $7\times10^4$ to $10\times10^4$ were obtained.

TABLE 1

| Example of Preparation | Resin for Dispersion Stabilization | Monomer | Wt. Mol. | Ave. Wt. |
|---|---|---|---|---|
| 2 | P-2 | Dodecyl methacrylate | 100 g | $9.5\times10^4$ |
| 3 | P-3 | Dodecyl methacrylate | 100 g | $9\times10^4$ |
| 4 | P-4 | Tetradecyl methacrylate | 100 g | $10\times10^4$ |
| 5 | P-5 | Hexadecyl methacrylate | 100 g | $8.5\times10^4$ |
| 6 | P-6 | Docosanyl methacrylate | 100 g | $8.6\times10^4$ |
| 7 | P-7 | Octadecyl methacrylate | 70 g | $8.0\times10^4$ |
| | | Decyl methacrylate | 30 g | |
| 8 | P-8 | Dodecyl methacrylate | 80 g | $9.4\times10^4$ |
| | | Butyl methacrylate | 20 g | |
| 9 | P-9 | Dodecyl methacrylate | 95 g | $7.5\times10^4$ |
| | | N,N-Diethylaminoethyl methacrylate | 5 g | |
| 10 | P-10 | Dodecyl methacrylate | 96 g | $7.0\times10^4$ |
| | | Diacetone acrylamide | 4 g | |

EXAMPLE 11

The Preparation of a Resin for Dispersion Stabilization Purposes: Preparation of the Resin P-11

A liquid mixture comprising 98.5 grams of octadecyl methacrylate, 1.5 grams of thioglycolic acid and 100 grams of toluene was heated to 75° C. under a blanket of nitrogen. Next, 0.4 gram of 1,1'-azobis(cyclohexan-1-carbonitrile) was added and the mixture was reacted for a period of 5 hours, after which a further 0.3 grams of the aforementioned azobis compound was added and the mixture was reacted for a further period of 5 hours. Next, 0.4 grams of tert-butylhydroquinone was added to the reaction mixture and then, while maintaining at the same temperature, 5.0 grams of vinyl propionate, and 0.8 gram of tetrabutoxy-titanium were added and the mixture was reacted for a period of 15 hours. After reaction, the mixture was reprecipitated in 3 liters of methanol whereupon 78 grams of a slightly brown colored powder was obtained. The weight average molecular weight of this powder was 68,000.

EXAMPLE 12

The Preparation of a Resin for Dispersion Stabilization Purposes: Preparation of the Resin P-12

A liquid mixture comprising 100 grams of dodecyl methacrylate and 200 grams of tetrahydrofuran was heated to 65° C. under a blanket of nitrogen, 4 grams of 2,2'-azobis(4-cyanovaleric acid chloride) was added and the mixture was agitated for a period of 10 hours. The reaction mixture was cooled to a temperature below 25° C. in a water bath and 2.4 grams of allyl alcohol was added. Pyridine (2.5 grams) was then added dropwise in such a way that the reaction temperature did not exceed 25° C., after which the mixture was agitated under the same conditions for a period of 1 hour. After reacting for a further period of 2 hoursat 40° C. the mixture was reprecipitated in 2 liters of methanol. A light brown sticky material was recovered by decantation and dried. The recovery was 80 grams of material of weight average molecular weight 45,000.

EXAMPLE 13

The Preparation of a Resin for Dispersion Stabilization Purposes: Preparation of the Resin R-13

A liquid mixture comprising 100 grams of hexadecyl methacrylate, 150 grams of toluene and 50 grams of ethanol was heated to 75° C. under a blanket of nitrogen. Next, 3.0 grams of ACV was added and the mixture was reacted for a period of 6 hours, after which a further 0.5 gram of A.C.V. was added and the mixture was reacted for a period of 4 hours. Next, the reaction mixture was reprecipitated in 3 liters of methanol, the methanol was removed by decantation and the remaining sticky material was dried.

A liquid mixture comprising 50 grams of this sticky material, 6.0 grams of allyl alcohol, 0.1 gram of hydroquinone and 100 grams of toluene was agitated at room temperature to form a uniform solution. Concentrated sulfuric acid (0.3 gram) was added to this uniform solution and the mixture was heated to 110° C. The mixture was reacted until all the water had been removed using Dean and Stark apparatus. After reacting for 24 hours, the mixture was cooled and reprecipitated in 3 liters of methanol, the methanol was removed by decantation and the remaining slightly brown colored sticky material was dried. The recovery was 38 grams and the weight average molecular weight was 56,000.

EXAMPLES 14–19

The Preparation of a Resin for Dispersion Stabilization Purposes: Preparation of the Resins P-14–P-19

Each of the resins P-14–P-19 was prepared using the same procedure as in Example 12 of the preparation of a resin for dispersion stabilization purposes except that the monomers indicated in Table 2 below were used in place of the dodecyl methacrylate used in the aforementioned Example 12. Polymers having a weight average molecular weight from $4.8\times10^4$ to $6.3\times10^4$ were obtained.

TABLE 2

| Example of Preparation | Resin for Dispersion Stabilization | Monomer | Wt. Mol. | Average Weight |
|---|---|---|---|---|
| 14 | P-14 | Octadecyl methacrylate | 100 g | 48,000 |
| 15 | P-15 | Octadecyl methacrylate | 70 g | 53,000 |

TABLE 2-continued

| Example of Preparation | Resin for Dispersion Stabilization | Monomer | Wt. Mol. | Average Weight |
|---|---|---|---|---|
| | | Dodecyl methacrylate | 30 g | |
| 16 | P-16 | Docosanyl methacrylate | 100 g | 55,000 |
| 17 | P-17 | Tetradecyl methacrylate | 80 g | 50,000 |
| | | Octadecyl methacrylate | 20 g | |
| 18 | P-18 | Octadecyl methacrylate | 95 g | 63,000 |
| | | 2-(Trimethoxysilyl)ethyl methacrylate | 5 g | |
| 19 | P-19 | Tridecyl methacrylate | 94 g | 52,000 |
| | | 2-Chloroethyl-methacrylate | 6 g | |

EXAMPLE 20

The Preparation of a Resin for Dispersion Stabilization Purposes: Preparation of the Resin P-20

A liquid mixture comprising 100 grams of octadecyl methacrylate, 150 grams of toluene and 50 grams of ethanol was heated to 70° C. under a blanket of nitrogen. Two grams of ACV was added, with agitation and the mixture was reacted for a period of 6 hours, after which a further 0.5 gram of A.C.V. was added and the mixture was reacted for a period of 4 hours.

After cooling, the mixture was reprecipitated in 3 liters of methanol whereupon 85 grams of a white powder was obtained by filtration and drying.

A mixture comprising 50 grams of the above mentioned powder, 3.7 grams of glycidyl methacrylate. 1.0 gram of 2,2'-methylenebis(6-tert-butyl-p-cresol), 0.5 gram of N,N-dimethyldodecylamine and 100 grams of toluene was heated to 100° C. and reacted for a period of 12 hours. The reaction mixture was reprecipitated in 1.5 liters of methanol and a light yellow colored powder was recovered by filtration and dried. Recovery was 39 grams and the weight average molecular weight was 35,000.

EXAMPLE 21

The Preparation of a Resin for Dispersion Stabilization Purposes: Preparation of the Resin P-21

A liquid mixture comprising 100 grams of octadecyl methacrylate and 200 grams of tetrahydrofuran was heated while stirring to 70° C. under a blanket of nitrogen. Five grams of 4,4'-azobis(4-cyanopentanol) was added and the mixture was reacted for a period of 5 hours, after which a further 1 gram of the above mentioned azobis compound was added and the mixture was reacted for a period of 5 hours. The reaction mixture was then cooled to 20° C. in a water bath, after which 3.2 grams of pyridine and 1.0 gram of 2,2'-methylenebis(6-tert-butyl-p-cresol) was added and the mixture was agitated. Methacrylic acid chloride (4.2 grams) was then added dropwise to this liquid mixture over a period of 30 minutes in such a way that the reaction temperature did not exceed 25° C. The reaction mixture was then agitated for a period of 4 hours at a temperature of from 20° C. to 25° C. Next, the reaction mixture was reprecipitated in a mixture comprising 1.5 liters of methanol and 0.5 liter of water and a white powder was recovered by filtration and dried. The recovery was 86 grams and the weight average molecular weight was 33,000.

EXAMPLES 22-31

The Preparation of a Resin for Dispersion Stabilization Purposes: Preparation of the Resins P-22-P-31

Each of the resins for dispersion stabilization purposes P-22 to P-31 was prepared using the same procedure as in Example 21 of the preparation of a resin for dispersion stabilization purposes except that the acid chlorides indicated in Table 3 were used in place of the methacrylic acid chloride using in Example 21. The weight average molecular weight of each resin was from 30,000 to 40,000.

TABLE 3

| Example of Preparation | Resin for Dispersion Stabilization Purposes | Acid Chloride | Amount Added |
|---|---|---|---|
| 22 | P-22 | $CH_2{=}CH{-}COCl$ | 2.0 g |
| 23 | P-23 | $CH_2{=}CH{-}CH_2{-}COCl$ | 2.4 g |
| 24 | P-24 | 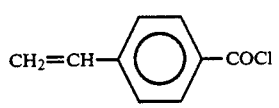 | 3.4 g |
| 25 | P-25 | $CH_3{-}CH{=}CH{-}COCl$ | 2.2 g |
| 26 | P-26 | $CH_2{=}CH{-}CH_2OCO(CH_2)_2COCl$ | 4.0 g |
| 27 | P-27 | $CH_2{=}CH{-}COO(CH_2)_2COCl$ | 3.3 g |
| 28 | P-28 | $CH_2{=}C(CH_3){-}COO(CH_2)_2OCO(CH_2)_2COCl$ | 5.0 g |
| 29 | P-29 | $CH_2{=}C(CH_3){-}CONH(CH_2)_{10}COCl$ | 6.1 g |
| 30 | P-30 | $CH_2{=}CH{-}CH_2OCO(CH_2)_3COCl$ | 4.1 g |

TABLE 3-continued

| Example of Preparation | Resin for Dispersion Stabilization Purposes | Acid Chloride | Amount Added |
|---|---|---|---|
| 31 | P-31 | $CH_2=C(CH_2COOCH_3)(COCl)$ | 3.3 g |

EXAMPLE 1

The Preparation of Latex Particles: Preparatin of Latex Particles D-1

A liquid mixture comprising 12 grams of the resin for dispersion purposes P-1, 100 grams of vinyl acetate, 1.5 grams of illustrative compound II-19 for monomer (B) and 384 grams Isopar-H was heated to 70° C. while agitating the mixture under a blanket of nitrogen. Next, 0.8 gram of 2,2'-azobis(isovaleronitrile) (referred to hereinafter as AIVN) was added and the mixture was reacted for a period of 6 hours. A white turbidity appeared 20 minutes after adding the initiator and the temperature had risen to 88° C. The temperature was raised to 100° C. and the mixture was agitated for a period of 2 hours, after which the unreacted vinyl acetate was distilled off. After cooling, a white colored dispersion was obtained by straining the mixture through a 200 mesh nylon cloth to provide a latex of average particle size 0.20 μm with a polymerization rate of 86%.

EXAMPLES 2–22

The Preparation of Latex Particles: Preparation of Latex Particles D-2–D-22

Latex particles D-2 to D-22 were prepared using the same procedure as in Example 1 of the preparation of latex particles except that the resins for dispersion stabilization purposes and monomers (B) indicated in Table 4 below were used in place of the resin for dispersion stabilization purposes P-1 and the monomer (B), illustrative compound II-19, in Example 1 of the preparation of latex particles.

The polymerization rate was 85% –90% in each case.

TABLE 4

| Example of Latex Prep. | Latex Particles | Resin for Dispersion Stabilization | Monomer (B) | Average Particle Size of the Latex |
|---|---|---|---|---|
| 2 | D-2 | P-1 | II-1 | 0.19 μm |
| 3 | D-3 | P-1 | II-2 | 0.19 |
| 4 | D-4 | P-1 | II-3 | 0.20 |
| 5 | D-5 | P-1 | II-8 | 0.22 |
| 6 | D-6 | P-1 | II-9 | 0.22 |
| 7 | D-7 | P-1 | II-10 | 0.20 |
| 8 | D-8 | P-1 | II-11 | 0.18 |
| 9 | D-9 | P-1 | II-14 | 0.17 |
| 10 | D-10 | P-1 | II-18 | 0.21 |
| 11 | D-11 | P-2 | II-10 | 0.19 |
| 12 | D-12 | P-3 | II-19 | 0.20 |
| 13 | D-13 | P-4 | II-20 | 0.22 |
| 14 | D-14 | P-5 | II-21 | 0.22 |
| 15 | D-15 | P-6 | II-22 | 0.23 |
| 16 | D-16 | P-12 | II-23 | 0.23 |
| 17 | D-17 | P-14 | II-24 | 0.22 |
| 18 | D-18 | P-16 | II-15 | 0.23 |
| 19 | D-19 | P-18 | II-16 | 0.18 |
| 20 | D-20 | P-23 | II-26 | 0.19 |
| 21 | D-21 | P-24 | II-27 | 0.20 |
| 22 | D-22 | P-26 | II-29 | 0.21 |

EXAMPLE 23

The Preparation of Latex Particles: Preparation of Latex Particles D-23

A liquid mixture comprising 8 grams (as solid fraction) of the resin P-25 obtained in Example 25 of the preparation of a resin for dispersion stabilization purposes, 7 grams of poly(dodecyl methacrylate), 100 grams of vinyl acetate, 1.5 grams of monomer (B), illustrative compound II-15, and 380 grams of n-decane was heated to 75° C. with agitation under a blanket of nitrogen. Next, 1.0 gram of 2,2'-azobis(isobutyronitrile) (referred to hereinafter as AIBN) was added and the mixture was reacted for a period of 4 hours, after which a further 0.5 gram of A.I.B.N. was added and the mixture was reacted for a period of 2 hours. The temperature was raised to 110° C. and the mixture was agitated while distilling off the low boiling point solvent and the residual vinyl acetate. After cooling, the white colored dispersion obtained on passing the mixture through a 200 mesh nylon cloth formed a latex of average particle size 0.20 μm.

EXAMPLE 24

The Preparation of Latex Particles: Preparation of Latex Particles D-24

A liquid mixture comprising 14 grams of the resin P-1 obtained in Example 1 of the preparation of a resin for dispersion stabilization purposes, 85 grams of vinyl acetate, 2.0 grams of monomer (B), illustrative compound II-23, 15 grams of N-vinylpyrrolidone and 400 grams of isododecane was heated to 65° C., with agitation, under a blanket of nitrogen. Next, 1.5 grams of A.I.B.N. was added and the mixture was reacted for a period of 4 hours. After cooling, the white colored dispersion obtained by passing through a 200 mesh nylon cloth formed a latex of average particle size 0.26 μm.

EXAMPLE 25

The Preparation of Latex Particles: Preparation of Latex Particles D-25

A liquid mixture comprising 12 grams of the resin P-5 obtained in Example 5 of the preparation of a resin for dispersion stabilization purposes, 100 grams of vinyl acetate, 1.5 grams of monomer (B), illustrative compound II-18, 5 grams of 4-pentenic acid and 383 grams of Isopar-G was heated to 60° C., with agitation, under a blanket of nitrogen. Next, 1.0 gram of AIVN was added and the mixture was reacted for a period of 2 hours, after which a further 0.5 gram of AIVN was added and the mixture was reacted for a period of 2 hours. After cooling, the white colored dispersion obtained by passing through a 200 mesh nylon cloth formed a latex of average particle size 0.25 μm.

EXAMPLE 26

The Preparation of Latex Particles: Preparation of Latex Particles D-26

A liquid mixture comprising 20 grams of the resin P-20 obtained in Example 20 of the preparation of a resin for dispersion stabilization purposes, 2 grams of monomer (B), illustrative compound II-16, 100 grams of methyl methacrylate and 478 grams of Isopar-H was heated to 65° C., with agitation, under a blanket of nitrogen. Next, 1.2 gram of AIVN was added and the mixture was reacted for a period of 4 hours. After cooling, the coarse particles were removed by passing through a 200 mesh nylon cloth and the white colored dispersion thus obtained formed a latex of average particle size 0.36 μm.

EXAMPLE 27

The Preparation of Latex Particles: Preparation of Latex Particles D-27

A liquid mixture comprising 18 grams of the resin P-21 obtained in Example 21 of the preparation of a resin for dispersion stabilization purposes, 100 grams of styrene, 4 grams of monomer (B), illustrative compound II-22 and 380 grams of Isopar-H was heated to 50° C., with agitation, under a blanket of nitrogen. Next, an amount of n-butyl lithium/hexane solution such that the weight of solid material was 1.0 gram was added and the mixture was reacted for a period of 4 hours. After cooling, the white colored dispersion obtained by passing through a 200 mesh nylon cloth formed a latex of average particle size 0.30 μm.

EXAMPLE 28

The Preparation of Latex Particles (Comparative Example A)

A white colored dispersion with latex particles of average particle size 0.23 μm was obtained at a polymerization rate of 88% using the same procedure as used in Example 1 of the preparation of latex particles except that a liquid mixture comprising 20 grams of poly(octadecyl methacrylate) (weight average molecular weight 35,000), 100 grams of vinyl acetate, 1.5 grams of monomer (B), illustrative compound II-19, and 380 grams of Isopar-H was used.

EXAMPLE 29

The Preparation of Latex Particles (Comparative Example B)

A white colored dispersion with latex particles of average particle size 0.25 μm was obtained at a polymerization rate of 90% using the same procedure as used in Example 1 of the preparation of latex particles except that a liquid mixture comprising 14 grams of the resin for dispersion stabilization purposes indicated below, 100 grams of vinyl acetate, 1.5 grams of monomer (B), illustrative compound II-19, and 386 grams of Isopar-H was used.

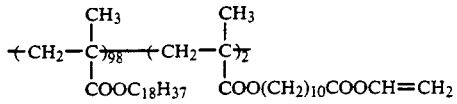

EXAMPLE 1 AND COMPARATIVE EXAMPLES A & B

Ten grams of dodecyl methacrylate/acrylic acid copolymer (copolymer ratio 95/5, by weight), 10 grams of nigrosine and 30 grams of Shellsol 71 were introduced into a paint shaker (made by the Tokyo Seiki Co.) along with glass beads and a fine dispersion of nigrosine was obtained by dispersing the mixture for 4 hours.

A liquid developer for electrostatic photography was then prepared by diluting 30 grams of the resin dispersion D-1 of Example 1 of the preparation of latex particles, 2.5 grams of the above mentioned nigrosine dispersion, 0.08 gram of octadecene/hemi maleic acid octadecylamide copolymer and 15 grams of FOC-1400 (a higher alcohol, manufactured by the Nissan Kagaku Co.) with 1 liter of Shellsol 71.

(Comparative Examples A & B)

Two types of liquid developer for comparative purposes, liquid developers A and B, were prepared by substituting the resin dispersions indicated below for the resin dispersion D-1 in the example of the preparation of a liquid developer described above

Comparative Liquid Developer A

The resin dispersion of Example 28 of the preparation of latex particles.

Comparative Liquid Developer B

The resin dispersion of Example 29 of the preparation of latex particles.

These liquid developers were used as developers in a fully automatic plate making machine model ELP404V (made by the Fuji Photo Film Co., Ltd.) in which ELP Master type II electrophotographic photosensitive material (made by the Fuji Film Co.) was being exposed and developed. The plate making process was carried out at a speed of 5 plates per minute. Moreover, whether or not toner attachment and contamination of the developing apparatus had occurred was checked after processing 2,000 ELP Master type II plates. The blackening factor (image area) of the copy image was measured using an original of 30%. The results obtained were as shown in Table 5.

TABLE 5

| No. | Experiment | Developer | Contamination of the Developing Apparatus | Image on the 2000th Plate |
|---|---|---|---|---|
| 1 | This Invention | Example 1 | No toner Contamination | Clear |
| 2 | Comparative A | Developer A | Pronounced toner contamination | Text drop-out, Uneven Blockied Parts and Fogging |
| 3 | Comparative B | Developer B | Slight Toner Contamination | Low $D_{max}$ in Blocked Parts Fine Breaks in |

It is clear from the results shown in Table 5 that when plates were made using each developer under the plate making conditions aforementioned, the developer of this invention gave rise to no contamination of the developing apparatus and produced clear images after making 2,000 plates.

On the other hand, printing was carried out in the normal way using the master plates for offset printing purposes (ELP masters) obtained on making plates with each developer and the numbers of copies printed in each case before any drop-out of text or unevenness of the blocked parts for example in the image on the printed copies were compared. It was found that the master plates obtained using the developer of this invention and the developers of comparative examples A & B did not give rise to these phenomena on printing more than 10,000 copies.

It is clear from the results described above that only when the developing agent of this invention was used was there no contamination of the development apparatus at all and the possibility of obtaining master plates which were good for many printed copies.

The number of prints with the master plate was not a problem in comparative examples A and B, but there was marked contamination of the development apparatus and it could not be used continuously.

The results show that the resin particles of the present invention are clearly superior.

EXAMPLE 2

A mixture of 100 grams of the white dispersion D-2 obtained in Example 2 of the preparation of latex particles and 1.5 grams of Sumicaron Black was heated to 100° C. and agitated with heating for a period of 4 hours. After cooling to room temperature, the mixture was passed through a 200 mesh nylon cloth and the residual dye was removed, and a black resin dispersion of average particle size 0.20 μm was obtained.

Thirty two grams of the above mentioned black resin dispersion and 0.05 grams of zirconium naphthenate were diluted with 1 liter of Shellsol 71 to prepare a liquid developer.

When development was carried out with this liquid developer using the same apparatus as used in example 1 there was no toner attachment and contamination of the apparatus at all even after developing 2,000 plates.

Furthermore, the image quality of the master plates for offset printing purposes obtained was clear and the image quality of the printed material was very clear after printing 10,000 copies.

EXAMPLE 3

A mixture of 100 grams of the white dispersion D-25 obtained in Example 25 of the preparation of latex particles and 3 grams of Victoria Blue B was heated to 70° C. -80° C. and agitated for a period of 4 hours. After cooling to room temperature, the mixture was passed through a 200 mesh nylon cloth and the residual dye was removed, and a blue resin dispersion of average particle size 0.26 μm was obtained.

Thirty two grams of the above mentioned black resin dispersion and 0.05 grams of zirconium naphthenate were diluted with 1 liter of Isopar-H to prepare a liquid developer.

When development was carried out with this liquid developer using the same apparatus as used in Example 1 there was no toner attachment and contamination of the apparatus at all even after developing 2,000 plates. Furthermore, the image quality of the master plates for offset printing purposes obtained was clear and the image quality of the printed material was very clear after printing 10,000 copies.

EXAMPLE 4

A mixture of 32 grams of the white dispersion D-2 obtained in Example 2 of the preparation of latex particles, 2.5 grams of the nigrosine dispersion obtained in example 1 and 0.02 gram of a hemi-docosanylamido compound of a octadecyl vinyl ether/maleic anhydride copolymer was diluted with 1 liter of Isopar-G to prepare a liquid developer.

When development was carried out with this liquid developer using the same apparatus as used in Example 1 there was no toner attachment and contamination of the apparatus at all even after developing 2,000 plates. Furthermore, the image quality of the master plates for offset printing purposes obtained and the image quality of the printed material after printing 10,000 copies were clear.

Moreover, the same processing was carried out after leaving the developer to stand for a period of 3 months and there had been no change with the passage of time.

EXAMPLE 5

Ten grams of poly(decyl methacrylate), 30 grams of Isopar-H and 8 grams of Alkali Blue were introduced into a paint shaker together with some glass beads and dispersed for a period of 2 hoursto provide a fine dispersion of Alkali Blue.

Thirty grams of the white dispersion D-10 obtained in Example 10 of the preparation of latex particles, 4.2 grams of the Alkali Blue dispersion above mentioned and 0.06 gram of the hemi-docosanylamido compound of a diisobutylene/maleic anhydride copolymer were diluted with 1 liter of Isopar-G to prepare a liquid developer.

When development was carried out with this liquid developer using the same apparatus as used in Example 1 there was no toner attachment and contamination of the apparatus at all even after developing 2,000 plates. Furthermore, the image quality of the master plates for offset printing purposes obtained and the image quality of the printed material after printing 10,000 copies were very clear.

EXAMPLES 6–22

Liquid developers were prepared in the same way as in Example 5 except that the latex particles indicated in Table 6 were used in such an amount as to provide a solid fraction of 6.0 grams in place of the white resin dispersion D-10 of latex particles used in Example 5.

TABLE 6

| Example | Latex Particles | Contamination of the Apparatus | Image Quality of the 2000$^{th}$ Plate |
|---|---|---|---|
| 6 | D-3 | No Attachment | Clear |
| 7 | D-4 | " | " |
| 8 | D-5 | " | " |
| 9 | D-6 | " | " |
| 10 | D-7 | " | " |
| 11 | D-9 | " | " |
| 12 | D-11 | " | " |
| 13 | D-12 | " | " |
| 14 | D-13 | " | " |
| 15 | D-14 | " | " |
| 16 | D-15 | " | " |
| 17 | D-16 | " | " |
| 18 | D-17 | " | " |
| 19 | D-18 | " | " |
| 20 | D-19 | " | " |
| 21 | D-20 | " | " |

TABLE 6-continued

| Example | Latex Particles | Contamination of the Apparatus | Image Quality of the 2000th Plate |
|---|---|---|---|
| 22 | D-22 | " | " |

No toner attachment or contamination of the apparatus was observed at all even after developing 2,000 plates when development was carried out using the same apparatus as used in Example 1. Furthermore, the image quality of the master plates for offset printing purposes obtained and the image quality of the printed material after making 10,000 copies were very clear.

Developers which have excellent dispersion stability, redispersion properties and fixing properties are obtained by means of this invention. In particular, even when the developers are used under very high speed plate making conditions there is no contamination of the developing apparatus and the image quality of the master plates for offset printing purposes obtained and the image quality of the printed material obtained after printing 10,000 copies are very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography resin particles dispersed in a non-aqueous solvent whose electrical resistance is at least $10^9$ Ω·cm and whose dielectric constant is not more than 3.5, wherein said dispersed resin particles are obtained by polymerizing a solution containing at least one monofunctional monomer (A) which is soluble in said non-aqueous solvent, but is rendered insoluble by polymerization and at least one monomer (B) represented by general formula 9II) whih has at least two polar groups and/or polar linking grups, in the presence of ar esin for dispersion stabilization purposes which has a plymerizable double bond containing group which can copolymerize with the monofunctional monomer (A) at only one end of the main chain of a polyme containing at least one repeating unit which can be represented by general formula (I):

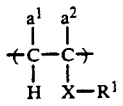

(I)

wherein X is selected from the group consisting of —COO—, —OCO—, —$CH_2$OCO—, —$CH_2$COO—, —O— and —$SO_2$—;

$R^1$ is an aliphatic group which has from 6 to 32 carbon atoms and which may be substituted; and $a^1$ and $a^2$ which may be the same or different, each is selected from the group consisting of a hydrogen atom, a halogen atom, a cyano grup, a hydrocarbyl group which has from 1 to 8 carbon atoms, a —COO—$R^2$ group or a —COO—$R^2$ group linked via a hydocarbyl group which has from 1 to 9 carbon atoms where $R^2$ is a hydrocarbyl group which has from 1 to 22 carbon atoms:

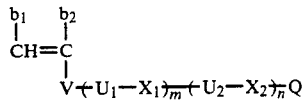

(II)

wherein V is selected from the group consisting of —COO—, —OCO—, —$CH_2$OCO—, —$SO_2$O, —CONH—, —$SO_2$NH—,

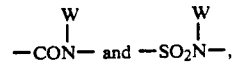

where W is a hydrocarbyl group or a grup which has the same meaning as the bond group —$U_1$—$X_1)_m$—$U_2$—$X_2)_n$ Q in general formula (II);

Q is selected from the group consisting of a hydrogen atom and a hydrocarbyl group which has from 1 to 18 carbon atoms and which may be substituted with halogen, —OH, —CN, —$NH_2$, —COOH, —$SO_3$H or —$PO_3H_2$;

$X_1$ and $X_2$ which may be the same or different, each is selected from the group consisting of —O—, —S—, —CO—, —$CO_2$—,

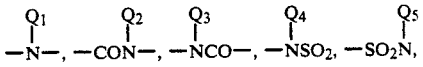

—$NHO_2$— and —NHCONH—, where $Q_1$, $Q_2$, $Q_3$, and $Q_5$ have the same significance as Q described above;

$U_1$ and $U_2$ which may be the same or different, each is a hydrocarbyl group which may be substituted and which may insert a

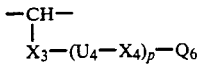

group into the bonds of the main chain, wherein $X_3$ and $X_4$ may be the same o different, having the same meaning as $X_1$ and $X_2$ described above, $U_4$ is a hydrocarbyl group which has from 1 to 18 carbon atoms which may be substituted, and $Q_6$ has the same meansing as Q described above;

$b_1$ and $b_2$ may be the same or different, each being selected from the group consisting of a hydrogen atom, a hydrocarbyl group, a —COO—L group and a —COO—L group linked via a hydrocarbyl group, where L is selected from the group constisting of a hydrogen atom and a hydrocarbyl group which may be substituted; and m, n and p which may be the same or different, each is an integer value of from 0 to 4.

2. A liquid developer as in claim 1, wherein X is selected from the group consisting of —COO—, —$CH_2$COO— and —O—.

3. A liquid developer as in claim 1, wherein substituent groups for $R^1$ are selected from the group consisting of halogen atoms, —O—$R^3$, —COO'$R^3$ and —OCO—$R^3$, where $R^3$ is an alkyl grop which has from 6 to 22 carbon atoms.

4. A liquid developer as in claim 1, wherein the polymerizable double bond containing group is bonded to one end of the main chain of the dispersion stabilizing resin polymer by a linking group having a structure comprising any combination of carbon-carbon bonds, carbon-hetero atom bonds and hetero atom-hetero atom bonds.

5. A liquid developer as in claim 1, wherein monomer (A) is represented by general formula (IV):

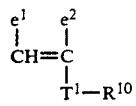

(IV)

wherein $R^1$; is selected from the group consisting of —COO—, —OCO—, —$CH_2OCO$—, —$CH_2COO$—, —O—,

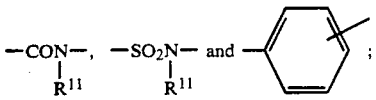

$R^{11}$ is selected from the group consisting of a hydrogen atom and an aliphatic group which has from 1 to 18 carbon atoms and which may be substituted;

$R^{10}$ is selected from the group consisting of a hydrogen atom and an aliphatic group which has from 1 to 6 carbon atoms which may be substituted; and $e^1$ and $e^2$ which may be the same or different, each has the same meaning as $a^1$ and $a^2$ in general formula (I).

6. A liquid develoepr as in claim 1, wherein monomer (A) is selected from the group consisting of vinyl esters and acrylic esters of aliphatic carboxylic acids having from 1 to 6 carbon atoms, alkyl esters and amides of unsaturated carboxylic acids wherein he alkyl moiety has from 1 to 4 carbon atoms and may be substituted, styrene derivatives, unsaturated acids, and heterocyclic compounds which contain a polymerizable double bond.

7. A liquid developer as in claim 1, wherien V in general formula (II) is selected from the group consisting of —COO—, —CONH— and

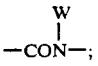

wherein W is a hydrocarbyl group or a group having the same meaning as the bond group —$U_1$—$X_1)_m$—$U_2$—$X_2)_n$ Q.

8. A liqui develoepr as in claim 1, wherien $b_1$ and $b_2$, which may be the same or different, each is selected from the group consisting of a hydrogen atom, methyl group, —COO—L group and —$CH_2COO$—L group, where L is an alkyl group which has from 1 to 18 carbon atoms.

9. A liquid developer as in claim 1, wherein the amount of monomer (B) represented by the general formula (II) is from 0.1 to 30 wt. % with respect to the insolubilized monomer (A).

10. A liquid developer as in claim 1, wherein the weight average molecular weight of the dispersed resin is from $10^3$ to $10^6$.

11. A liquid developer as in claim 1, wherein said liquid developer further comprises at least one coloring agent.

12. A liquid developer as in claim 1, wherein said dispersed resin particles are colored by physical dispersion in said particles of a pigment or dye.

* * * * *